US007658686B2

(12) United States Patent
Soracco

(10) Patent No.: US 7,658,686 B2
(45) Date of Patent: Feb. 9, 2010

(54) GOLF CLUB HEAD WITH CONCAVE INSERT

(75) Inventor: Peter L. Soracco, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 170 days.

(21) Appl. No.: 11/110,733

(22) Filed: Apr. 21, 2005

(65) Prior Publication Data

US 2006/0240910 A1 Oct. 26, 2006

(51) Int. Cl.
*A63B 53/04* (2006.01)

(52) U.S. Cl. ..... 473/342; 473/334; 473/345; 473/349

(58) Field of Classification Search ..... 473/324–350, 473/292
See application file for complete search history.

(56) References Cited

U.S. PATENT DOCUMENTS 3,166,320 A * 1/1965 Onions ..... 473/314
3,941,390 A * 3/1976 Hussey ..... 473/292
3,966,210 A * 6/1976 Rozmus ..... 473/341
4,021,047 A * 5/1977 Mader ..... 473/345
4,653,756 A * 3/1987 Sato ..... 473/327
4,792,140 A * 12/1988 Yamaguchi et al. ..... 473/331
4,869,507 A * 9/1989 Sahm ..... 473/337
4,872,683 A * 10/1989 Doran et al. ..... 473/249
5,186,465 A * 2/1993 Chorne ..... 473/350
5,205,560 A * 4/1993 Hoshi et al. ..... 473/345
5,213,328 A * 5/1993 Long et al. ..... 473/346
5,255,913 A * 10/1993 Tsuchida ..... 473/329
5,272,802 A * 12/1993 Stites, III ..... 29/527.2
5,310,186 A * 5/1994 Karsten ..... 473/345
5,346,217 A * 9/1994 Tsuchiya et al. ..... 473/345
5,435,558 A * 7/1995 Iriarte ..... 473/327
5,769,736 A * 6/1998 Sato ..... 473/335
5,785,609 A * 7/1998 Sheets et al. ..... 473/327
D418,885 S 1/2000 Wanchena
6,012,989 A * 1/2000 Saksun, Sr. ..... 473/341
6,139,446 A 10/2000 Wanchena
6,162,133 A 12/2000 Peterson
6,248,025 B1 * 6/2001 Murphy et al. ..... 473/324
6,248,026 B1 6/2001 Wanchena
6,332,848 B1 * 12/2001 Long et al. ..... 473/328
6,422,951 B1 * 7/2002 Burrows ..... 473/328
6,482,106 B2 * 11/2002 Saso ..... 473/327
6,565,452 B2 * 5/2003 Helmstetter et al. ..... 473/342
6,645,086 B1 * 11/2003 Chen ..... 473/335
6,739,984 B1 * 5/2004 Ciasullo ..... 473/345
6,860,818 B2 * 3/2005 Mahaffey et al. ..... 473/256
7,070,517 B2 * 7/2006 Cackett et al. ..... 473/342

(Continued)

FOREIGN PATENT DOCUMENTS

JP 2003-093554 4/2003

(Continued)

*Primary Examiner*—Sebastiano Passaniti
(74) *Attorney, Agent, or Firm*—Hanify & King, P.C.

(57) ABSTRACT

A hollow golf club head with a concave portion is disclosed and claimed. The club head includes a metallic portion and a light weight portion, which may be formed of plastic, composite, or the like. The concave portion allows the club designer to make a club head having very thin portions while still maintaining the requisite structural integrity. Convex bulges may optionally be provided to house weight inserts to enhance the playing characteristics of the golf club.

27 Claims, 2 Drawing Sheets

U.S. PATENT DOCUMENTS

| | | | | |
|---|---|---|---|---|
| 7,524,249 | B2 * | 4/2009 | Breier et al. | 473/342 |
| 2001/0001302 | A1 * | 5/2001 | Murphy et al. | 473/345 |
| 2001/0049310 | A1 * | 12/2001 | Cheng et al. | 473/334 |
| 2003/0045371 | A1 * | 3/2003 | Wood et al. | 473/328 |
| 2003/0100381 | A1 * | 5/2003 | Murphy et al. | 473/342 |
| 2004/0138002 | A1 * | 7/2004 | Murray | 473/327 |
| 2005/0170907 | A1 * | 8/2005 | Saso | 473/345 |

FOREIGN PATENT DOCUMENTS

| | | |
|---|---|---|
| JP | 2004-121744 | 4/2004 |
| JP | 2004-159680 | 6/2004 |
| JP | 2004-337327 | 12/2004 |
| WO | WO2004/052472 | 6/2004 |

* cited by examiner

GOLF CLUB HEAD WITH CONCAVE INSERT

BACKGROUND OF THE INVENTION

1. Field of the Invention

The present invention relates to a golf club, and, more particularly, the present invention relates to a large wood-type golf club head with a concave insert.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their shots, particularly their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits.

SUMMARY OF THE INVENTION

The present invention relates to a large wood-type golf club head with a concave insert. The club head is formed of a plurality of body members that define an interior volume. A first body member is made of a metallic material and includes a sole portion and a face portion. A second body portion is made of a light weight material, such as plastic, composite, or a very thin sheet of low density metallic material. The second body portion makes up at least a portion of the club head skirt, and includes one or more concave indentations that extends into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
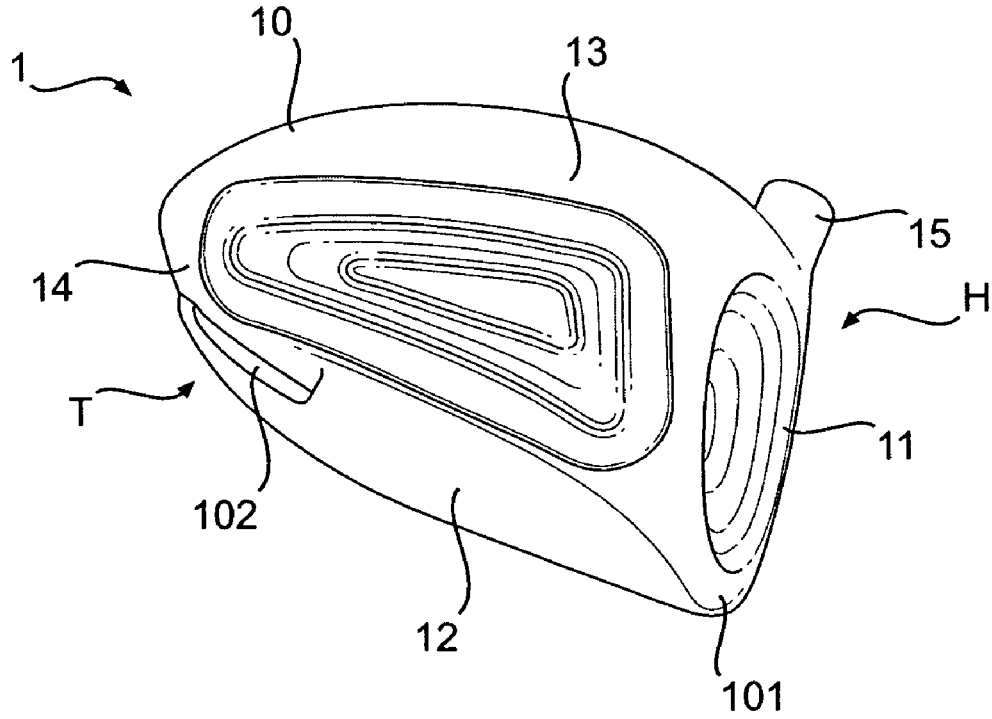
FIG. 1 shows a golf club head of the present invention.

FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 may be provided with grooves or score lines therein of varying design. The club head 1 has a toe T and a heel H.

Figure 2:
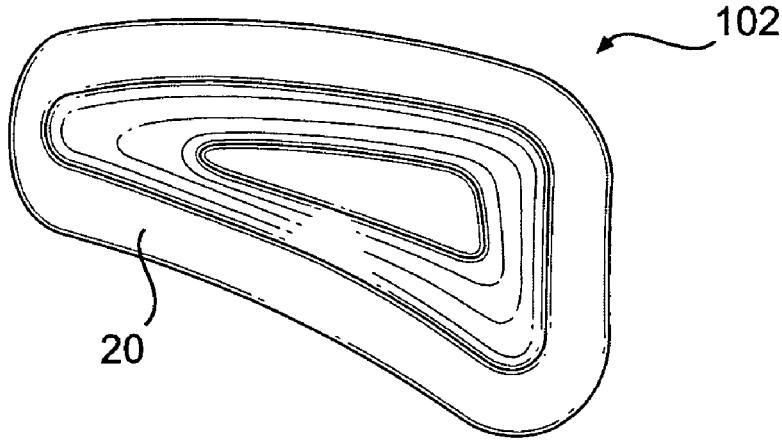
FIG. 2 snows a body member of the golf club head of FIG. 1.

The club head 1 is comprised of a plurality of body members that cooperatively define the interior volume 16. A first body member 101 includes a sole portion and a face portion. The first body member may include a complete face 11 and sole 12. Alternatively, either or both the face 11 and the sole 12 can be inserts coupled to the first body member 101. The club head 1 also includes at least one second body member 102 coupled to the first body member 101 along the skirt 14 in known fashion. The crown 13 can be unitarily a portion of either body member 101, 102 or it may be an insert coupled to either of the body members 101, 102. The second body member 102 includes a concave portion 20 that, when the body members 101, 102 are coupled together, extends inward into the interior volume 16. FIG. 2 shows an isolated view of an exemplary second body member 102.

The first body member 101 preferably is formed of a metallic material such as stainless steel, aluminum, or titanium. The material of the first body member 101 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 1, such as the skirt 14, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 1. These portions of the club head 1 can also be made thinner, enhancing the weight savings. Exemplary uses for this redistributed weight include increasing the overall size of the club head 1, expanding the size of the club head "sweet spot," which is a term that refers to the area of the face 11 that results in a desirable golf shot upon striking a golf ball, repositioning the club head 1 center of gravity, and/or produce a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 1, such as the heel H, the toe T, or the sole 12, maximizes the opportunity to enlarge the sweet spot or produce a greater MOI, making the golf club hotter and more forgiving.

The second body member 102 is light-weight, which gives the opportunity to displace the club head center of gravity downward and to free weight for more beneficial placement elsewhere without increasing the overall weight of the club head 1. When the wall thickness of the second body member 102 is at the minimum range of the preferred thickness, a reinforcing body layer can be added in the critical areas in case the member shows deformations. These benefits can be further enhanced by making the second body member 102 thin. To ensure that the structural integrity of the club head 1 is maintained, these thin panels may preferably include a concave portion 20. Inclusion of these concave portions 20 allow the second body member 102 to withstand greater stress—both longitudinally and transversely—without sustaining permanent deformation or affecting the original cosmetic condition, ensuring the structural integrity of the club head 1 is maintained. Preferred thicknesses for the first body member 101 include from 0.03 inch to 0.05 inch, while preferred thicknesses for the second body member 102 include from 0.015 inch to 0.025 inch. Preferably, the concave portion 20 displaces at least 10 cubic centimeters. More preferably, the concave portion 20 displaces at least 25 cubic centimeters. While the club head 1 can be virtually any size, preferably it is a legal club head. A plurality of concave portions 20 may be used with the club head 1. For example, concave portions 20 of uniform or varying size may be positioned in the toe, heel, back, etc.

Figure 3:
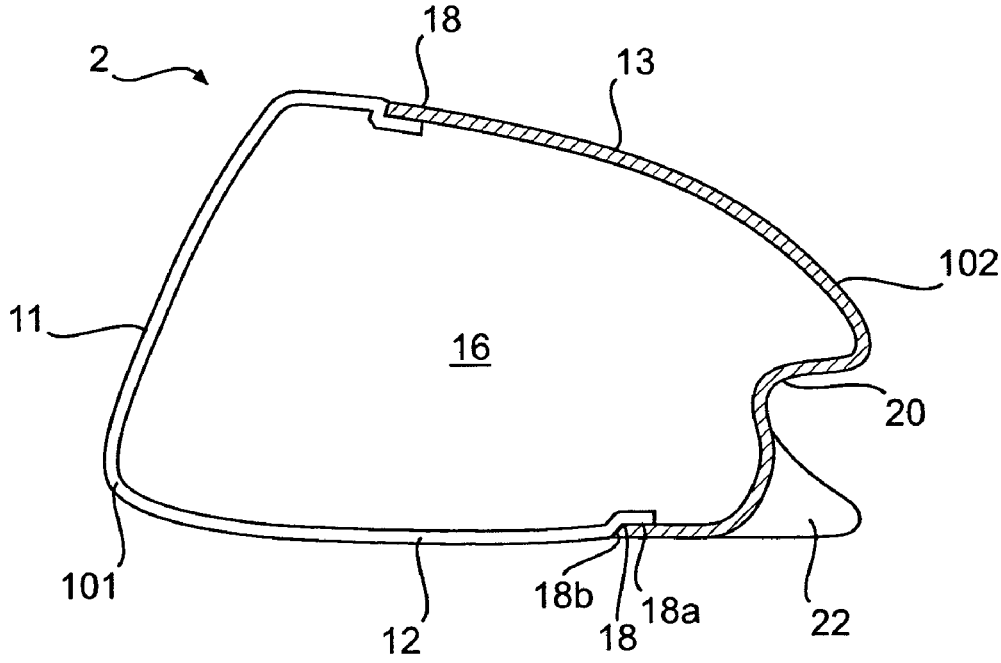
FIG. 3 shows a second club head of the present invention.
Figure 4:
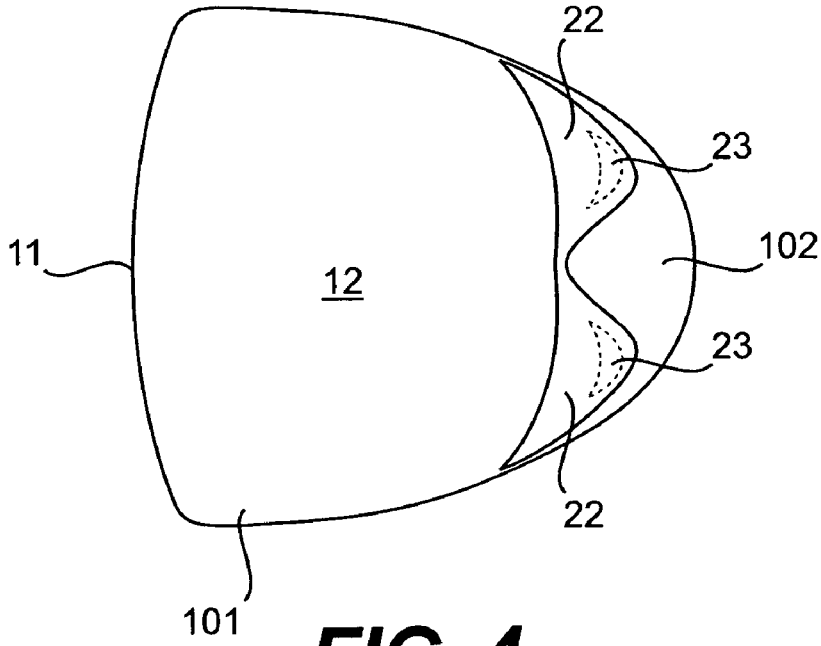
FIG. 4 shows a bottom view of the club head of FIG. 3.

FIG. 3 shows a cross-sectional view taken substantially perpendicular to the face 11 of a second club head 2 of the present invention, and FIG. 4 shows a bottom view of the club head 2. In the illustration of this embodiment, the concave portion 20 is positioned at the back of the club head 2. The concave portion 20 preferably is not visible to the golfer at address. In addition to the concave portion 20, the second body member 102 further includes a convex bulge 22 that extends generally away from the interior volume 16. An insert 23 may be positioned within the convex bulge. The insert 23 is not visible from outside the club head 2, and is thus illustrated using broken lines. In a preferred embodiment, the insert 23 is a weight insert. The convex nature of the bulge 23 allows the weight to be positioned to maximize the mechanical advantage it lends to the club head 2. As shown in FIG. 4, the club head 2 may include a plurality of convex bulges 22, such as on a heel side and on a toe side of the club head 2. The club designer may place inserts 23 as desired within the bulges 22. The masses of the inserts may be substantially equal. Alternatively, one of the inserts may have a greater mass than the other. This may be beneficial to design the club to correct a hook swing or a slice swing. A preferred mass range for the weight insert 23 is from 1 gram to 50 grams.

As shown in FIG. 3, the first body member 101 may comprise a majority of the sole 12 and the second body member 102 may include a majority of the crown 13. This beneficially removes a large majority of the mass from the upper part of the club head 2. In this embodiment the first body member 101 includes an attachment perimeter 18 that extends around its edge. The second body member 102 is coupled to the first body member 101 along the attachment perimeter 18. The first and second body members 101, 102 cooperatively define the interior volume 16. The attachment perimeter 18 preferably may contain a step defining two attachment surfaces 18*a*, 18*b*. As illustrated, the second body member 102 may be coupled to both of these surfaces 18*a*, 18*b* to help ensure a strong bond between the body members 101, 102.

While the body members 101, 102 may be formed in a variety of manners, a preferred manner includes forming a complete club head shell (first body member 101) in known manner and removing material to create openings to which the second body member 102 can be coupled. The opening may be created in any desired manner, such as with a laser. The second body member 102 may be joined to the first body member 101 in a variety of manners, such as through bonding or through a snap-fit in conjunction with bonding. If a composite material is used for the concave inserts, molding six plies of 0/90/45/-45/90/0 is preferred.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while two body members have been described above, the present invention may be embodied in a club head having more than two body members. Additionally, the present invention may be embodied in any type of club in addition to the wood-type clubs shown in the illustrated embodiments. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a plurality of body members cooperatively defining an interior volume;

said plurality of body members including a first body member having a sole portion and a face portion, the face portion including score lines; and said plurality of body members including a second body member coupled to said first body member, said second body member comprising a skirt portion having a plurality of concave indentations extending into said interior volume and a convex bulge extending generally away from said interior volume, wherein the plurality of concave indentations displaces a volume of at least 10 cubic centimeters, and are configured and dimensioned to allow the skirt to withstand stress longitudinally and transversely, and wherein the convex bulge furthers comprises an insert positioned therein having a mass from 1 gram to 50 grams.

2. The golf club head of claim 1, wherein:

said first body member comprises a first material having a first density; and said second body member comprises a second material having a second density less than said first density.

3. The golf club head of claim 2, wherein:

said first body member comprises a metallic material; and said second body member comprises a light-weight metal alloy, a plastic, or a composite material.

4. The golf club head of claim 1, wherein:

said first body member comprises a first material having a first thickness; and said second body member comprises a second material having a second thickness less than said first thickness.

5. The golf club head of claim 4, wherein:

said first thickness is from 0.03 inch to 0.05 inch; and said second thickness is from 0.015 inch to 0.025 inch.

6. The golf club head of claim 1, further comprising a sole insert coupled to said first body member at said sole portion and a face insert coupled to said first body member at said face portion.

7. The golf club head of claim 1, wherein the plurality of concave indentations is located on a toe portion of said skirt, substantially opposite a shaft attachment portion of the club head.

8. The golf club head of claim 1, wherein the plurality of concave indentations is substantially unfilled.

9. The golf club head of claim 1, wherein the plurality of concave indentations is visible from the exterior of the golf club head.

10. A golf club head, comprising:

a plurality of body members cooperatively defining an interior volume;

said plurality of body members including a first body member having a sole portion and a face portion, the face portion including score lines; and said plurality of body members including a second body member coupled to said first body member, said second body member comprising a skirt portion having a plurality of concave indentations extending into said interior volume and displacing a volume of at least 10 cubic centimeters;

wherein said second body member further comprises:

a first convex bulge extending generally away from said interior volume, wherein said first convex bulge comprises a first insert; and a second convex bulge extending generally away from said interior volume, wherein second convex bulge comprises a second insert;

and wherein the plurality of concave indentations is configured and dimensioned to withstand stress longitudinally and transversely.

11. The golf club head of claim 10, wherein said first convex bulge is located on a heel side of the club head and said second convex bulge is located on a toe side of the club head.

12. The golf club head of claim 10, wherein said first and second inserts are weight inserts, each of said inserts having a mass from 1 gram to 50 grams.

13. The golf club head of claim 12, wherein said first weight insert has a greater mass than said second weight insert.

14. The golf club head of claim 12, wherein said second weight insert has a greater mass than said first weight insert.

15. The golf club head of claim 12, wherein:

said first weight insert has a first mass; and said second weight insert has a second mass substantially equal to said first mass.

16. A golf club head, comprising:

a first body member having a face and an attachment perimeter, the face including score lines; and a second body member coupled to said first body member along said attachment perimeter to define a club head interior volume;

wherein said second body member includes a plurality of concave indentations extending into said interior volume and a convex bulge extending generally away from said interior volume, wherein said concave indentations displace a volume of at least 10 cubic centimeters and are selectively positioned to withstand stress transversely and longitudinally, and wherein the convex bulge further comprises an insert positioned therein.

17. The golf club head of claim 16, wherein said insert is a weight insert having a mass from 1 gram to 50 grams.

18. The golf club head of claim 16, wherein:

said attachment perimeter contains a step defining two attachment surfaces; and said second body member is coupled to said first body member along both of said attachment surfaces.

19. The golf club head of claim 16, wherein:

said first body member includes a majority of a sole of the club head; and said second body member includes a majority of a crown of the club head.

20. The golf club head of claim 16, wherein:

said first body member comprises a metallic material; and said second body member comprises a plastic or composite material.

21. The golf club head of claim 16, further including a face insert coupled to said first body member.

22. A golf club head, comprising:

a plurality of body members cooperatively defining an interior volume, wherein the plurality of body members comprises:

a first body member having a sole portion and a face portion, wherein the face portion comprises an insert and score lines, and wherein the sole portion comprises a sole insert; and a second body member coupled to the first body member, wherein the second body member comprises a skirt portion comprising a plurality of concave indentations extending into said interior volume and displacing a volume of at least 10 cubic centimeters, and wherein the plurality of concave indentations are configured and dimensioned to allow the skirt to withstand stress longitudinally and transversely.

23. The golf club head of claim 22, wherein the first body member comprises a majority of a sole of the club head and the second body member comprises a majority of a crown of the club head.

24. The golf club head of claim 22, wherein the first body member comprises a metallic material and the second body member comprises a plastic or composite material.

25. The golf club head of claim 22, wherein the face portion comprises a face insert.

26. The golf club head of claim 22, wherein the sole portion comprises a sole insert.

27. The golf club head of claim 22, wherein the second body member further comprises a convex bulge extending generally away from the interior volume.

* * * * *